US009514593B2

(12) United States Patent
Dopfer et al.

(10) Patent No.: US 9,514,593 B2
(45) Date of Patent: Dec. 6, 2016

(54) METHOD AND APPARATUS FOR PROCESSING VALUE DOCUMENTS

(71) Applicant: GIESECKE & DEVRIENT GMBH, Munich (DE)

(72) Inventors: Peter Dopfer, Geltendorf (DE); Erwin Demmeler, Memmingen (DE); Oskar Dicklberger, Munich (DE); Thomas Hildebrandt, Pliening (DE)

(73) Assignee: GIESECKE & DEVRIENT GMBH, Munich (DE)

( * ) Notice: Subject to any disclaimer, the term of this patent is extended or adjusted under 35 U.S.C. 154(b) by 0 days.

(21) Appl. No.: 14/405,839

(22) PCT Filed: Jun. 5, 2013

(86) PCT No.: PCT/EP2013/001649
§ 371 (c)(1),
(2) Date: Dec. 5, 2014

(87) PCT Pub. No.: WO2013/182305
PCT Pub. Date: Dec. 12, 2013

(65) Prior Publication Data

US 2015/0179013 A1 Jun. 25, 2015

(30) Foreign Application Priority Data

Jun. 6, 2012 (DE) ..... 10 2012 011 231

(51) Int. Cl.
*G07D 11/00* (2006.01)
*B65H 7/02* (2006.01)
(Continued)

(52) U.S. Cl.
CPC ..... *G07D 11/0024* (2013.01); *B65B 69/00* (2013.01); *B65H 1/02* (2013.01);
(Continued)

(58) Field of Classification Search
CPC ..... G07D 11/0003; G07D 11/0006; G07D 11/0009; G07D 11/0012; G07D 11/0015; G07D 11/0021; G07D 11/0024; G07D 11/0096; B65H 31/3045; B65H 2220/01; B65H 2301/42242
See application file for complete search history.

(56) References Cited

U.S. PATENT DOCUMENTS 3,982,642 A * 9/1976 Muller ..... A46D 1/00 212/327
4,083,461 A * 4/1978 Wangermann ..... B65H 31/3045 206/386

(Continued)

FOREIGN PATENT DOCUMENTS

DE 20216636 U1 3/2004
DE 102007060653 A1 6/2009

(Continued)

OTHER PUBLICATIONS

Translation of PCT application PCT/EP2010/063927 (U.S. Appl. No. 13/497,946, original German-language PCT application published Mar. 31, 2011).*

(Continued)

*Primary Examiner* — Behrang Badii
*Assistant Examiner* — David Testardi
(74) *Attorney, Agent, or Firm* — Workman Nydegger

(57) ABSTRACT

The present invention relates to the automatic removal of value document stacks from a container with the aid of a gripper. For separating different value document stacks, the container is subdivided into several storage regions by separator elements. Since the separator element positions of different value document containers may be different, for the container to be respectively processed it is ascertained at which positions along the container the separator elements are arranged. Ascertaining the separator element positions is effected independently of the gripper at a time before the gripper is moved toward the container. The ascertained information items about the separator element positions belonging to the container are then transferred to a gripper control device of the gripper, which is configured for controlling the motion of the gripper in order to remove value documents from the container.

17 Claims, 3 Drawing Sheets

(51) Int. Cl.

| | |
|---|---|
| ***B65H 31/30*** | (2006.01) |
| ***B65H 1/02*** | (2006.01) |
| ***B65H 1/28*** | (2006.01) |
| ***B65H 1/30*** | (2006.01) |
| ***B65B 69/00*** | (2006.01) |

(52) U.S. Cl.

CPC ..... *B65H 1/28* (2013.01); *B65H 1/30* (2013.01); *B65H 7/02* (2013.01); *B65H 31/3045* (2013.01); *G07D 11/0006* (2013.01); *B65H 2301/42242* (2013.01); *B65H 2301/422542* (2013.01); *B65H 2405/3312* (2013.01); *B65H 2405/352* (2013.01); *B65H 2511/20* (2013.01); *B65H 2553/414* (2013.01); *B65H 2701/1912* (2013.01)

(56) References Cited

U.S. PATENT DOCUMENTS

| | | | | | |
|---|---|---|---|---|---|
| 4,776,080 | A | | 10/1988 | Christensen | |
| 4,792,865 | A | * | 12/1988 | Baumeister | G11B 27/11 360/133 |
| 4,911,608 | A | * | 3/1990 | Krappitz | B25J 13/086 294/87.1 |
| 5,126,580 | A | * | 6/1992 | Hiraoka | B65H 1/04 250/559.15 |
| 5,186,303 | A | | 2/1993 | Seto et al. | |
| 5,357,495 | A | * | 10/1994 | Solhjell | G11B 15/681 250/566 |
| 5,636,960 | A | * | 6/1997 | Hiroki | B65H 1/00 414/416.03 |
| 6,160,580 | A | * | 12/2000 | Nakashiba | H04N 3/1575 348/316 |
| 6,230,927 | B1 | * | 5/2001 | Schoonen | A61J 7/0084 221/10 |
| 6,351,001 | B1 | * | 2/2002 | Stevens | H01L 27/14806 257/223 |
| 6,449,531 | B1 | * | 9/2002 | Gune | H05K 13/021 700/218 |
| 7,653,977 | B2 | | 2/2010 | Wiedemann et al. | |
| 8,315,739 | B2 | | 11/2012 | Dai | |
| 8,682,471 | B2 | * | 3/2014 | Starr | G11B 15/6835 414/273 |
| 2004/0188303 | A1 | * | 9/2004 | Chouinard | B65D 85/48 206/456 |
| 2006/0042914 | A1 | | 3/2006 | Wiedemann et al. | |
| 2006/0245860 | A1 | * | 11/2006 | Moriya | H01L 21/67265 414/279 |
| 2006/0266930 | A1 | * | 11/2006 | Misawa | H01L 27/14623 250/214 R |
| 2008/0201012 | A1 | * | 8/2008 | Hoshino | G11B 15/6835 700/218 |
| 2009/0224187 | A1 | | 9/2009 | Berthe et al. | |
| 2010/0274391 | A1 | | 10/2010 | Dai | |
| 2012/0175217 | A1 | * | 7/2012 | Demmeler | B65H 1/027 194/206 |

FOREIGN PATENT DOCUMENTS

| | | | | |
|---|---|---|---|---|
| DE | 102009042891 | A1 | | 3/2011 |
| EP | 0841644 | A2 | | 5/1998 |
| EP | 1862270 | A2 | | 12/2007 |
| FR | 2698306 | A1 | | 5/1994 |
| JP | 10218381 | A | * | 8/1998 |
| KR | 1020070057475 | A | * | 6/2007 |
| WO | WO 2011/036157 | A1 | * | 3/2011 |

OTHER PUBLICATIONS

K-PION machine translation of KR 1020070057475 (original KR document published on Jun. 7, 2007).*

German Search Report for corresponding German Application No. 10 2012 011 231.9, Jan. 14, 2013.

International Search Report for corresponding International PCT Application No. PCT/EP2013/001649, Oct. 2, 2013.

* cited by examiner

METHOD AND APPARATUS FOR PROCESSING VALUE DOCUMENTS

BACKGROUND

The present invention relates to a method and an apparatus for processing value documents, in particular removing value documents from value document containers with the aid of a gripper.

For receiving bank notes there are employed containers in which the value documents, in particular bank notes, are present as separate units. Separate units are here understood to mean a quantity of at least one bank note or more which is associated with a certain person, an account, an accounting unit etc. Moreover, besides bank notes, the units may also comprise checks, vouchers or other documents of value. For example, the separate units may be formed of separate payments (deposits). Here, before the processing with a bank note processing machine the separate payments are prepared for the upcoming processing and filled into containers. For this, in particular data or information items of the payment are captured and made available for the processing of the bank note processing machine. The data may here comprise specifications about the depositor, an account number, the quantity and the value of the bank notes forming the payment, a unique transaction number, etc. In order to make possible an interruption-free processing by the bank note processing machine, the payments are separated from each other by header cards or separator cards which are inserted between different payments. The bank note processing machine recognizes these header cards or separator cards and thus also the beginning of a new payment.

For separating different stacks of value documents, from DE102009042891 A1 it is known to use separator elements by which a container can be flexibly subdivided into several storage regions for value documents. Into the containers, which are open on one side, there are inserted one or more value document stacks comprising loose value documents. For removing the value documents, the container is usually arranged such that its open side points upward and the value documents stand in the container on their longitudinal edges. The inner wall of the container as well as the separator elements advantageously have a meandering surface comprising several projections and recesses at their sides facing the value-document surfaces. For automatically removing the value document stack from the container by a gripper, there can be used a gripper having several gripping fingers which penetrate into the recesses of the meandering surface from above. The gripper has e.g. two rake-like gripping elements comprising several gripping fingers which can be moved toward each other and away from each other, in order to grip the value document stack reliably and without a risk of damage as soon as the gripping fingers have penetrated perpendicularly into the recesses of the container. In this way, the desired value document stack can be gripped, removed from the container and be deposited remote from the container or inserted into an apparatus for value-document processing.

The gripper is equipped with optical sensors, by which the light reflected by a reflection strip located at the container bottom can be detected. For ascertaining the positions in the container at which the separator elements are present and whether value documents are contained between the separator elements of the container, the gripper is moved along the longitudinal direction of the container. With the aid of the respectively detected sensor signal the gripper can ascertain whether at the respective position of the container above which the gripper is being located the reflection strip is visible or whether this is covered by value documents or by a separator element. With the aid of the sensors the gripper searches in this way for the correct position for lowering the gripping elements. When it has found the correct position, the gripping elements are lowered in order to remove the value document stack contained between the separator elements. After the first value document stack has been removed from the container and transported away by the gripper, the gripper returns to the container in order to remove the next value document stack, etc.

With the hitherto removal of the value document stacks it is disadvantageous that the gripper must check after each value document stack to be removed, whether and, if so, at which positions in the container the next value document stack to be removed is present, and that each time the gripper must search with the aid of its sensors for the correct position for lowering the gripper, because it can recognize this position only when it is in the lowering position above the separator element. Upon this search for the next lowering position, the gripper must be moved relatively slowly over the container.

A further disadvantage of this sequential capture of the separator element positions is that possibly faulty positionings of the separator elements are discovered only in the course of emptying a container. It may e.g. occur that the information items regarding the content of a container report data of five payments, but in actual fact there are present only four storage regions. It may also occur that the distance of the separator elements has been selected too large, so that the displacement region of the gripping elements is exceeded and the stack can no longer be reliably gripped. Upon sequential capture of the separator element positions such errors are only discovered when the container is already partly emptied. But an abortion of the value document removal at this time is disadvantageous, because then a time-consuming manual capture and post-processing of the partially emptied container is necessary.

SUMMARY

It is the object of the present invention to accelerate the removal of value document stacks from value-document containers.

The value documents are made available in a container which is open on one side and which is subdivided by separator elements into several storage regions for value documents, in which, where applicable, value documents are contained or not contained. For removing the value documents from the container there is employed a gripper which is configured for removing value documents contained in the container. The gripper is arranged such that it can insert a value document stack, which was removed from the container, into an input pocket of a value document processing apparatus. Since the separator element positions of different value document containers may be different, for the container to be respectively processed it is ascertained at which positions along the container the separator elements are arranged. Ascertaining the separator element positions is not effected by the gripper itself, however, but already at an earlier time, independently of the gripper, i.e. without the help of the gripper. Ascertaining the separator element positions of the container is carried out at a time before the gripper starts removing the value documents from the container. The positions of the separator elements can thus be ascertained without the help of sensors of the gripper. The ascertained information items about the separator element positions belonging to the container are then transferred to a gripper control device of the gripper, which is configured for controlling the motion of the gripper. For removing value documents from the container, the gripper control device controls the gripper corresponding to the previously transferred information items about the separator element positions such that the gripper is positioned at a lowering position above the respective separator element and is lowered from the lowering position into the container in order to remove value documents from the container.

Ascertaining the separator element positions of the container is carried out in particular at a time before the gripper is moved toward this container in order to remove value documents from this container. In particular, also the transfer of the information items about the separator element positions of the container to the gripper control device is carried out before the gripper is moved toward this container in order to remove value documents from this container. The information about the respectively next lowering position of the gripper is thus available to the gripper control device already before the gripper has arrived at the respective lowering position above the container, preferably before the gripper is moved toward the container in order to remove value documents from the container. In the case of a contradictory or faulty number and/or position of the separator elements an error message can be output and the removal by the gripper can be prevented, until the fault has been remedied or the entire container has been removed unemptied.

The position of the separator elements is not ascertained by the gripper, but by a different device or person. Therefore, the position of the separator elements of the respective container cannot be ascertained only when the gripper is moving toward the container, but is already known before. Since the gripper control device obtains the information about the separator element position of the respective container already earlier than hitherto, it is avoided that upon each removal of a stack the gripper must autonomously search anew for its next lowering position. Thus, the gripper can move faster to the correct lowering position. This accelerates the removal of the value documents from the container. This makes possible a continuously high processing speed of the value document processing apparatus even when the respective container has many small storage regions with few value documents.

The gripper has e.g. comb-like structures which are configured to mesh with free recesses of the separator elements, which recesses face the value documents' storage regions located between the separator elements. The gripper control device positions the gripper, in dependence on the respective separator element position, at a lowering position above the container, at which the gripping fingers of the gripper can penetrate into the recesses of the respective separator element by lowering the gripper into the container. After the removal from the container, the value documents removed from the container are inserted e.g. into an input pocket of a value document processing apparatus by the gripper and subsequently processed by the value document processing apparatus.

For obtaining the information items faster, ascertaining the separator element positions of the container can be automatically carried out simultaneously for several separator elements of the respective container. The separator element positions of the container are simultaneously ascertained before the gripper starts removing the value documents from the container, in particular before the gripper is moved toward the container for removing the value documents from the container. For example, for this purpose the separator element positions are automatically ascertained with the aid of one or several sensors, e.g. with sensors of a value document processing apparatus or sensors of an input module of a value document processing apparatus. For example, the separator element positions are simultaneously ascertained by a plurality of sensors which are arranged along a container receiving means into which the container is inserted for the removal of the value documents. The sensors are arranged along the container receiving means in such a way that each of the possible separator element positions of a container received in the container receiving means is respectively checkable by one of the sensors as to whether at the respective possible separator element position there is actually present a separator element in the container. Thus, the positions of all the separator elements actually present in the container can be simultaneously detected before the gripper starts removing the value documents from the container, in particular before the gripper is moved toward the container for removing the value documents from the container. Instead of by a plurality of sensors along the container receiving means, the separator element positions can also be automatically ascertained with the aid of an image sensor which generates an image of the container received in the container receiving means and ascertains the separator element positions from the taken image before the gripper starts removing the value documents from the container, in particular before the gripper is moved toward the container for removing the value documents.

Instead of simultaneously ascertaining all the separator elements of a container, the separator element positions can also be ascertained in groups simultaneously, respectively only one region of several possible separator element positions being automatically scanned simultaneously.

In an exemplary embodiment, the information items about the separator element positions are ascertained manually or automatically outside the capture region of the gripper and stored there in a data carrier of the container which is permanently fastened to the container. The information items about the separator element positions can be read out from the data memory by a reading device, e.g. by a reading device of a container receiving means in which the container is received upon the removal of the value documents. The read-out information items can be transferred from the reading device to the gripper control device before the gripper starts removing the value documents from the container, in particular before the gripper is moved toward the container for removing the value documents from the container.

The container can be equipped with a container identification, e.g. with a number and/or with a bar code applied to the container, which uniquely identifies the container itself or at least the container type (e.g. the size). In some exemplary embodiments, the information items about the separator element positions are manually or automatically ascertained outside the capture region of the gripper and linked there with the container identification of the respective container. The container identification is then transferred, together with the information items about the separator element positions linked therewith, via a data connection to the gripper control device, namely before the gripper starts removing the value documents from the container, in particular before the gripper is moved toward the container for removing the value documents from the container. The data connection can be e.g. a wireless or a wired network connection, via which the gripper control device obtains the information items. The information items transferred via the network connection are stored in a data memory, e.g. a data memory of the gripper control device. In the data memory there are stored e.g. the respective separator element positions linked with the respective container identification for several containers.

For determining the separator element positions of a container to be processed soon, the container identification of the container to be processed soon is read-out by a reading device e.g. while value documents are removed from a preceding container. For the read-out container identification of the container to be processed there are subsequently found, in the data memory, the information items about the separator element positions which were previously stored linked with the read-out container identification of the container to be processed. Thus, the information items are made available to the gripper control device before the gripper starts removing the value documents from the container, in particular before the gripper is moved toward the container for removing the value documents from the container.

The separator elements of the container can be stationary separator elements, whose positions are priorly known and invariable. For example, there are known one or several different container types with stationary separator elements, the containers of the respective container type having the same separator element positions. For the known container types these already known separator element positions can then be linked with the respective container identification and stored in the data memory, e.g. prior to the value document processing. Upon the processing of the container of a known container type, from the data memory there can then be selected, based on the container identification, the separator element positions valid for the respective container.

But the separator elements in the container can also be variably positionable, the separator elements being fastenable at freely selectable or at predetermined separator element positions in the container. The separator element positions then are only defined when the container is filled with value documents. In the case of separator elements with variable position, the read-out container identification of the container to be processed is compared for a match with the container identifications transferred via the data connection. The separator element positions of the container to be processed are then those separator element positions transferred via the data connection, which were linked with the matching container identification. Finding the linked separator element positions is carried out before the gripper starts removing the value documents from the container to be processed, e.g. during the removal of value documents from a preceding container which is processed prior to the container to be processed.

Outside the capture region of the gripper the ascertaining of the information items about the separator element positions can also be carried out by an operator who inputs the information items about the separator element positions at an operator interface before the gripper starts removing the value documents from the container, in particular before the gripper is moved toward the container for removing the value documents from the container. The separator element positions of a container to be processed e.g. are ascertained by the operator before the gripper has terminated the removal of value documents from the previously processed container. The operator interface can be an operator interface of a value document processing apparatus or the operator interface of an input module of a value document processing apparatus or the operator interface of a preparation place at which the containers are filled with value documents and/or are checked. The information about the separator element positions, which was input by the operator at the operator interface, is transferred from the operator interface via a data connection (directly or indirectly) to the gripper control device. The input separator element positions can be transferred to the input module or to the value document processing apparatus and there be made available to the gripper control device. The separator element positions input at the operator interface can also be immediately stored in the data carrier of the container, however.

Before the removal of the value documents from the container the information items about the separator element positions can be checked, e.g. for plausibility, and the gripper control device can stop the removal of the value documents by the gripper, if the check indicates a faulty state of the container. A faulty state may be e.g. a too large distance of the separator elements, which extends beyond the maximum distance of the gripping elements of the gripper. A plausibility check may comprise that the separator element positions, which were ascertained outside the capture region of the gripper at a first time, are subsequently ascertained by the one or more sensors or the image sensor at a second time, in order to check the separator element positions ascertained outside the capture region of the gripper. For the plausibility check, from the ascertained separator element positions there can be determined, alternatively or additionally, also the number and/or size of the storage regions of the container, and it can be checked whether these match with the number and/or amount of the payments, which were previously stated for the container, e.g. by the depositor or an operator. By the plausibility check, faults in the positioning of the separator elements are discovered already before the start of the value document removal. Since in this way an only partial emptying of the container is avoided, the manual effort for the post-processing of the "faulty" container is reduced.

The invention also relates to an apparatus for removing value documents from the container, which apparatus is configured for carrying out the method according to the invention. The apparatus can be a value document processing apparatus which has a gripper, or a robot for inputting bank notes into a value document processing apparatus, which robot has a gripper, or an input module which has a gripper and is configured for inputting bank notes into a value document processing apparatus. The input module can be attached to a value document processing apparatus such that value document stacks can be inserted, by the gripper, out of the input module, into the value document processing apparatus. The apparatus can also have two or several of these components (value document processing apparatus, robot, input module), however, as well as, where applicable, a container receiving means and/or a transport device for transporting several containers to a value document processing apparatus and/or a preparation place, at which the containers are prepared for the removal by the gripper.

The apparatus has a gripper for removing value documents contained in the container and a gripper control device for controlling the motion of the gripper. Optionally, the gripper has sensors which monitor the motion of the gripper in the working region and send corresponding information items to the gripper control device. Furthermore, the apparatus has a device which is configured to take up information items about the positions of the separator elements independently of the gripper, without the help of the gripper. The device can be an operator interface of the value document processing apparatus or of the input module or of a preparation place, into which the information items about the separator element positions are input by an operator, and which generates from the input information items corresponding digital information items. The device can also be a communication interface (e.g. a network interface or a device interface) of the value document processing apparatus or of the input module or of the robot or of a preparation place, which receives the information items. The device can also be a reading device of the value document processing apparatus or of the input module or of the robot or of a preparation place, which reads out the information items from a data memory of the container. The device is connected with the gripper control device, in order to transfer the taken information items about the positions of the separator elements to the gripper control device. The gripper control device is configured to control the motion of the gripper, for removing value documents from the container, in accordance with the transferred information items about the separator element positions, in such a way that the gripper is positioned at a lowering position above the respective separator element and that the gripper is lowered from the lowering position into the container in order to remove value documents from the container.

The device for taking up the information items about the separator element positions is neither a constituent of the gripper nor physically connected with the gripper. It is configured to get information items about the separator element positions supplied (from outside) and to transfer the information items about the separator element positions to the gripper control device at a time before the gripper starts removing the value documents from the container, in particular before the gripper is moved toward the container for removing the value documents from the container.

The apparatus can also have a container receiving means which receives the container in such a way that the relative position thereof to the gripper is predetermined and reproducible. The container receiving means can be configured for a manual insertion of the container. Preferably, the container receiving means has a mechanical rotation-protection, so that the container can be inserted into the container receiving means only in the correct orientation. The container housing then has a corresponding asymmetry. This ensures that the emptying of the storage regions is effected in a certain sequence and that the correct association of payments and/or associated header cards or separator cards is maintained. Where applicable, the apparatus has several container receiving means, so that the apparatus can simultaneously receive several containers loaded with value documents. The apparatus can also have a transport device, which is configured to transport containers filled with value documents into the capture region of the gripper and to transport the containers, after the removal of the value documents by the gripper, away from the capture region of the gripper. Or the apparatus can be connected with such a transport device.

The apparatus can also have one or several sensors, by which the separator element positions of the container are automatically ascertainable before the gripper is moved toward the container for removing the value documents, in particular a plurality of sensors which are arranged along the container receiving means. The sensors are arranged e.g. along the container receiving means in such a way that respectively one of the sensors is arranged at each of the possible separator element positions of a container received in the container receiving means. The apparatus can have a reading device for reading out the information items about the separator element positions from a data carrier of the container. The reading device can be integrated in the container receiving means, but it can also be arranged outside the container receiving means in/at the apparatus or at a container transport device which transports the containers to be emptied into the capture region of the gripper, or at the preparation place at which loaded value document containers arrive or are filled. It can read-out the information automatically or only after a manual actuation, e.g. if the respective container has a data carrier. The apparatus can also have a communication interface which is configured for receiving the information items about the separator element positions of the container from outside the apparatus, e.g. a network interface or a device interface to the value document processing apparatus.

BRIEF DESCRIPTION OF THE DRAWINGS

Hereinafter the invention will be explained by way of example with reference to the following Figures. There are shown.

DETAILED DESCRIPTION OF VARIOUS EMBODIMENTS

Figure 1A:
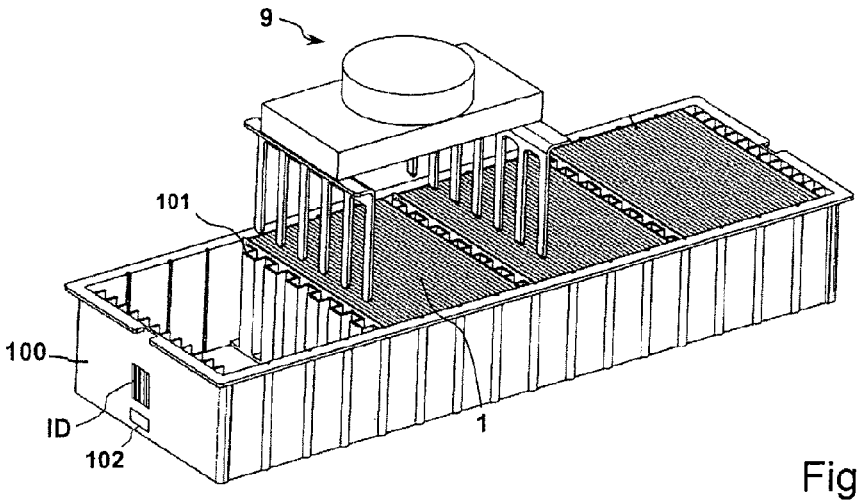
FIG. 1*a* a value document container with several separator elements and a gripper for removing value documents from the container, FIG. 1*b* an apparatus for processing value documents, having an input module attached thereto, FIG. 1*c* the value document removal from a value document container in an input module which is attached to an apparatus for processing value documents, FIG. 2 an apparatus for processing value documents, having a robot and a transport system for transporting value document containers to the apparatus, FIG. 3 the possible information flow regarding the information about the separator element positions for some exemplary embodiments.

FIG. 1*a* shows a container 100 for receiving value documents, in which the value documents 1 are inserted standing on their longitudinal edges. The container 100 is subdivided by three separator elements 101 into four storage regions in which value documents of different accounting units are kept separated from each other. The separator elements 101 can be positioned variably along the container, so that the size of the storage regions can be adjusted to value document stacks of different sizes. For this purpose, the separator elements 101 can be plugged in at different places of the container 100, at which the container wall has corresponding slots. For removing the value documents there is employed a gripper 9 which is lowered into the container 100 in order to remove the respective value document stack of a storage region. The container 100 has an identification ID, e.g. a bar code, by which the container is uniquely identifiable. In the case of a container type having stationary separator elements, whose separator element positions are known, it may be sufficient when at least the container type is indicated by the identification ID of the container.

Optionally, the container 100 has a data carrier 102, e.g. an RFID transponder, in which information items about the value documents 1 contained in the container are stored. These comprise e.g. information items about the depositor of the respective value document stack and, where applicable, about the number or the total value of the value documents. In the data carrier 102 there can also be stored information items about the positions of the separator elements 101 of the container 100, which were ascertained at an earlier time. These information items about the separator element positions could have been stored in the data carrier 102 e.g. upon the filling of the container with value documents, e.g. upon the filling of the container by machine, or upon the manual filling of the container, e.g. by the depositor of the value documents, or at the preparation place 40 of an apparatus 60 for value document processing, cf. FIG. 2. Alternatively, these information items can also be made available or linked by a machine readable header card or separator card which were inserted into the container at the beginning of the respective value document stack.

Figure 1C:
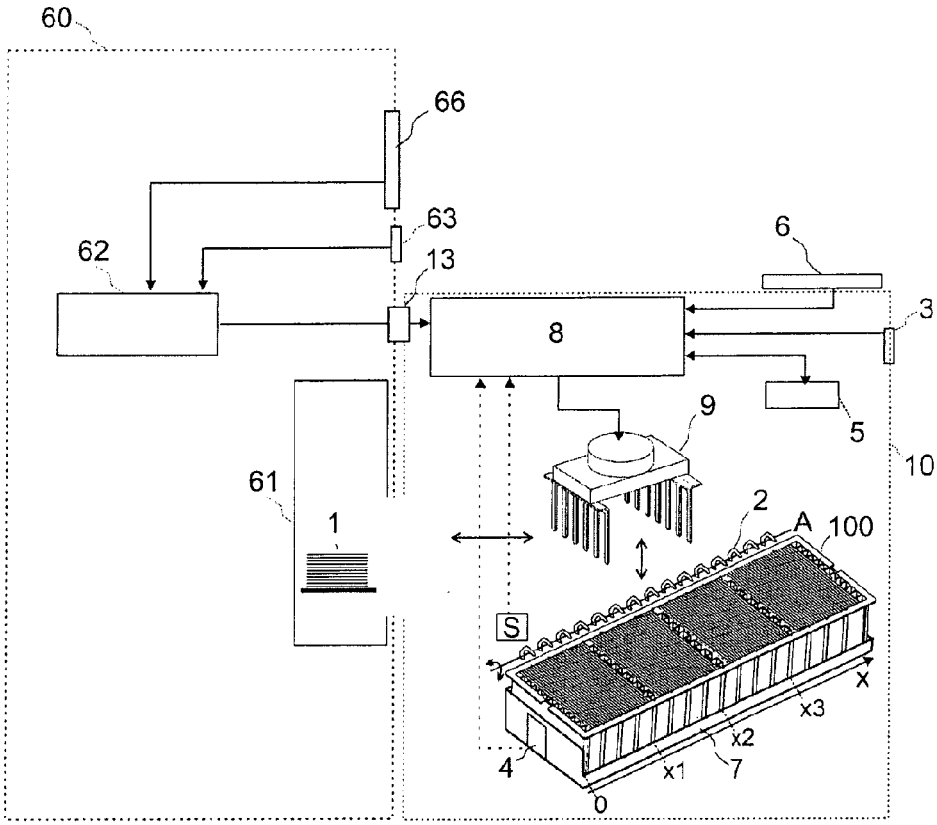
Figure 1B:
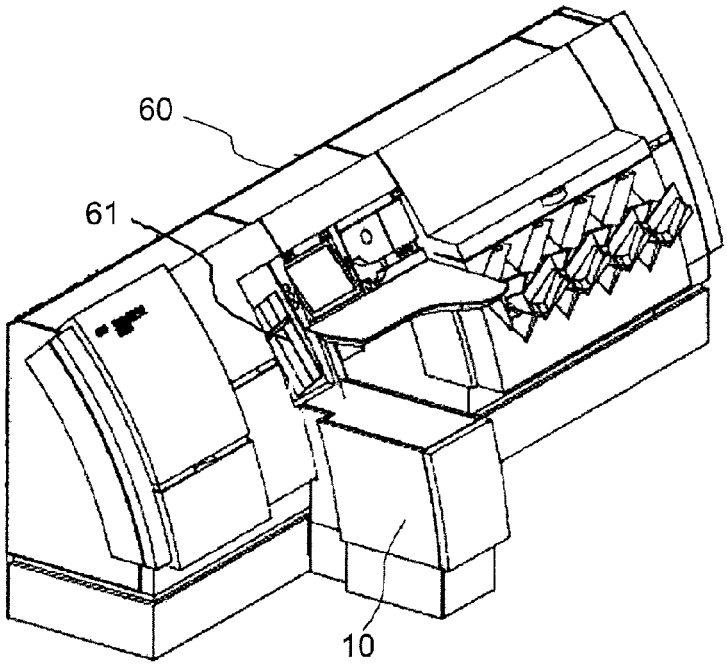

In FIG. 1*b* there is represented an apparatus 60 for processing value documents, at the input side of which an input module 10 is attached. The input module 10 is configured for the input of value documents, e.g. bank notes, into an input pocket 61 of the apparatus 60 and has for this purpose a gripper 9 which removes a stack of value documents from a container and inserts this into an input pocket 61 of the apparatus. The value documents 1 input in the input pocket are then singled, transported, checked, where applicable sorted, and deposited in one or several output pockets of the apparatus 60 by the apparatus 60. The input module 10 can be configured for receiving several value document containers 100 and thus form a kind of buffer storage for the container 100. For example, the input module 10 has a transport device, which transports containers filled with value documents into the capture region of the gripper 9 and transports the emptied containers, after the removal of the value documents by the gripper 9, away from the capture region of the gripper 9.

In FIG. 1*c* there is shown an exemplary embodiment of an input module 10 for the automatic removal of the value documents from the container 100. The input module 10 has a gripper 9 in order to remove value documents 1 in stacks from a storage region of the container 100 and insert these into the input pocket 61 of the apparatus 60. For this purpose the container 100 was manually or automatically inserted into a container receiving means 7 of the input module 10. The container receiving means 7 can be equipped with a reading device 4, in order to read out the identification ID of the container 100 and/or in order to read out information items about the separator element positions x of the container 100 from the data memory 102 of the container. The reading device 4 transfers the read-out information items to a gripper control device 8 of the gripper 9, which controls the motion of the gripper 9. The information items about the positions x of the separator elements 101 of the container 100 are thus available to the gripper control device 8 already shortly after the insertion of the container into the container receiving means, i.e. before the gripper 9 is moved toward the container 100 in order to remove the value documents 1 therefrom. The gripper control device 8 has e.g. a data memory 5 in which the information items about the positions x of the separator elements 101 can be stored. In the case of the shown container 100, these information items comprise the three x-positions x1, x2, x3 of the three separator elements 101 of the container, which state the distance of the separator elements from the fixed stop (x=0) at which the container rests against the front wall of the container receiving means 7. In the data memory 5 there are stored these information items about the positions x1, x2, x3 linked with the identification ID of the container 100, as well as, where applicable, corresponding information items for further containers with further identifications ID1-IDn.

Additionally or alternatively to the storage in the data memory 102 of the container, the information items about the separator element positions x1, x2, x3 of the container 100 can also be transferred via a network interface 3 of the input module 10 to the gripper control device 8. The information x1, x2, x3 can also be input via an operator interface 6 into the input module 10 by an operator and be transferred by the input module to the gripper control device 8. Instead, it is also possible, that the control device 62 of the apparatus 60 receives the information items about the separator element positions x1, x2, x3 of the container 100 via a network interface 63 of the apparatus 60 or via an operator interface 66 from an operator of the apparatus 60 and transfers these information items from the value document processing apparatus 60 via the device interface 13 to the gripper control device 8. The operator inputs the information items at the respective operator interface 6, 66 already at a time before the emptying of the container 100 begins, e.g. while a preceding container is being emptied by the gripper 9. The information items about the separator element positions x1, x2, x3 are transferred to the gripper control device 8 preferably linked with the container identification ID. If these information items are present already at an early stage before the removal of the value documents from the respective container, e.g. for a plurality of containers to be emptied, the gripper control device 8 stores the transferred information items in its data memory 5 and accesses the information items about the respective separator element positions only as needed, e.g. shortly before the gripper is to be moved toward the respective container.

Additionally or alternatively, the information items about the separator element positions can also be only ascertained in the input module 10, with the aid of sensors of the input module 10, namely at a time before the gripper 9 starts emptying the container 100. The information items about the separator element positions x1, x2, x3 of the container 100 can e.g. be ascertained while the gripper carries out the removal of the value documents from one of the preceding containers which is emptied before the container 100. In FIG. 1*c* there are shown for this purpose, by way of example, a plurality of mechanical sensors 2 which are arranged at certain positions along the longitudinal direction of the container receiving means 7. The mechanical sensors 2 have swivelling fingers which are jointly swivelling around an axis A in order to check whether or not at the respective position of the container 100 a separator element 101 is actually present. If the respective swivelling finger experiences mechanical resistance upon swivelling, it is held back by the separator element 101 and cannot follow the deflection of the other swivelling fingers around the axis A. The respective sensor 2 detects the individual deflection of the respective swivelling finger, e.g. by means of an inductive switch, a light barrier or the like. The individual sensors 2 are connected with a sensor control device S (connection not shown), which then transfers the corresponding information items about the separator element positions of the container 100 to the gripper control device 8. Instead of the mechanical sensors 2, there can also be employed electric, acoustic, optical, magnetic or other sensors, which are e.g. arranged analogously along the longitudinal direction of the container receiving means 7. Alternatively, the input module 10 can also have an image sensor (not shown), which takes an image of the respectively next container to be processed, ascertains the positions of the separator elements by means of image processing and transfers these information items to the gripper control device 8. Since with the aid of the above-mentioned sensors, or with the aid of the image sensor, the information items about the separator element positions can be simultaneously ascertained for a plurality of or all the separator elements of a container 100, there results a clear time saving in comparison to a serial capturing of the individual separator elements.

Moreover, the ascertained positions of the separator elements can be checked for plausibility before the gripper 9 starts removing the value documents 1. In so doing, it is e.g. checked, whether the number and/or size of the storage regions ascertained by the sensors 2 match the number and/or size of the payments. Upon the check it can also be checked whether the gripper 9 can reliably infer the distance of two neighboring separator elements, i.e. the size of a storage region. If the conditions on which the check is based are not observed, the operator can be prompted to correct the position of the separator elements 101 or to remove the container 100 completely and e.g. return it to the deliverer. A further embodiment comprises a self-test of the mechanical sensors 2. By rotating the swivelling fingers by way of trial before a container 100 is inserted in the container receiving means, it is possible to check the correct function of the sensors 2 and to output an error message in case of a malfunction.

Figure 2:
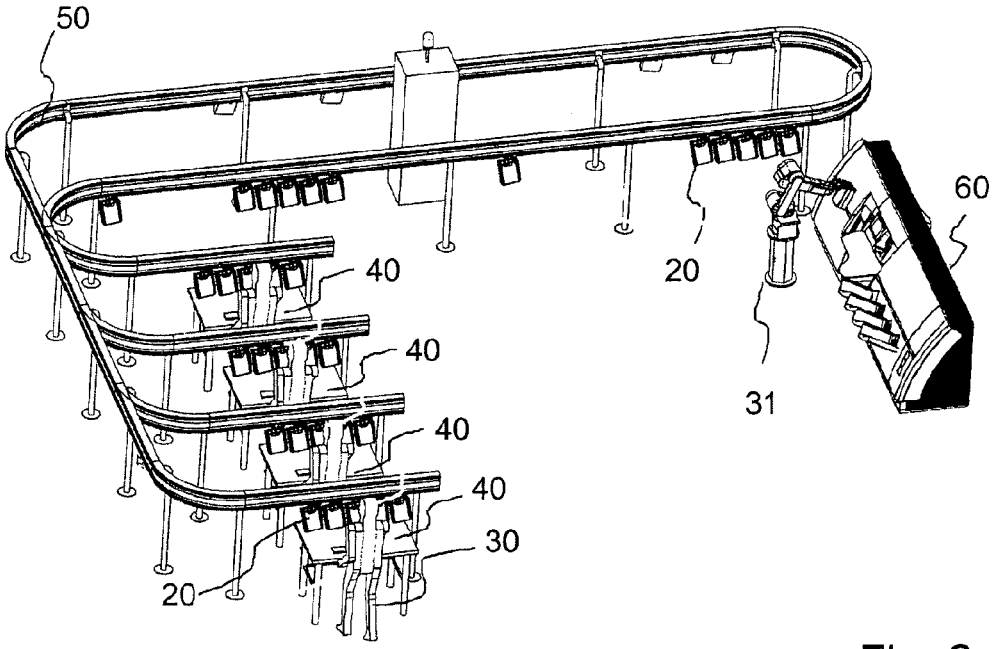

In FIG. 2 there is represented a further exemplary embodiment, in which for a value document processing apparatus 60 there is provided—instead of an input module 10—a robot 31 which has a gripper in order to remove value documents from containers 20 and insert these into the input pocket 61 of the apparatus 60. The robot can be autonomous or a part of the apparatus 60. The containers 20 loaded with value documents are transported to the apparatus 60 in the capture region of the robot gripper by means of a transport system 50. After the value document removal by the robot gripper the empty containers 20 are transported away from the robot and transported back to the processing places 40 by the transport system 50. At processing places 40 the containers 20 are prepared by operators 30 for the automatic removal of the value documents. The preparation comprises e.g. a checking of the container, if the containers arrive at the preparation places already loaded with value documents and/or the insertion of a header card or separator card at the beginning of the respective value document stack. The filling of the containers can also be only carried out at the preparation places 40, however. The preparation by the respective operator 30 comprises e.g. also ascertaining the positions of the separator elements which are stationary in the container 20 or are variably incorporated or are only incorporated by the operator 30. For this purpose, the operator inputs the separator element position e.g. at an operator interface 46 of the preparation place 40, cf. FIG. 3. In so doing, a digital information item about the separator element positions x of the respective container is generated and linked with a container identification ID of the respective container. Upon the later value document removal, with the help of the link there can be determined, on the basis of the container identification ID, the associated information items about the separator element positions of the container to be respectively emptied.

The robot 31 has a gripper control device 8 which possesses a data connection (e.g. wireless) to the apparatus 60 and/or to the processing places 40, via which the information items about the separator element positions x1, x2, x3, linked with the container identification ID, can be transferred to the gripper control device 8. The transfer of the information items to the gripper control device 8 can be effected as soon as the operator 30 has ascertained the positions of the separator elements 101 and has input these information items linked with the container identification ID at the processing places 40. The gripper control device 8 stores the transferred information in its data memory 5, so that it can access this as soon as the respective container is to be emptied by the robot gripper.

Figure 3:
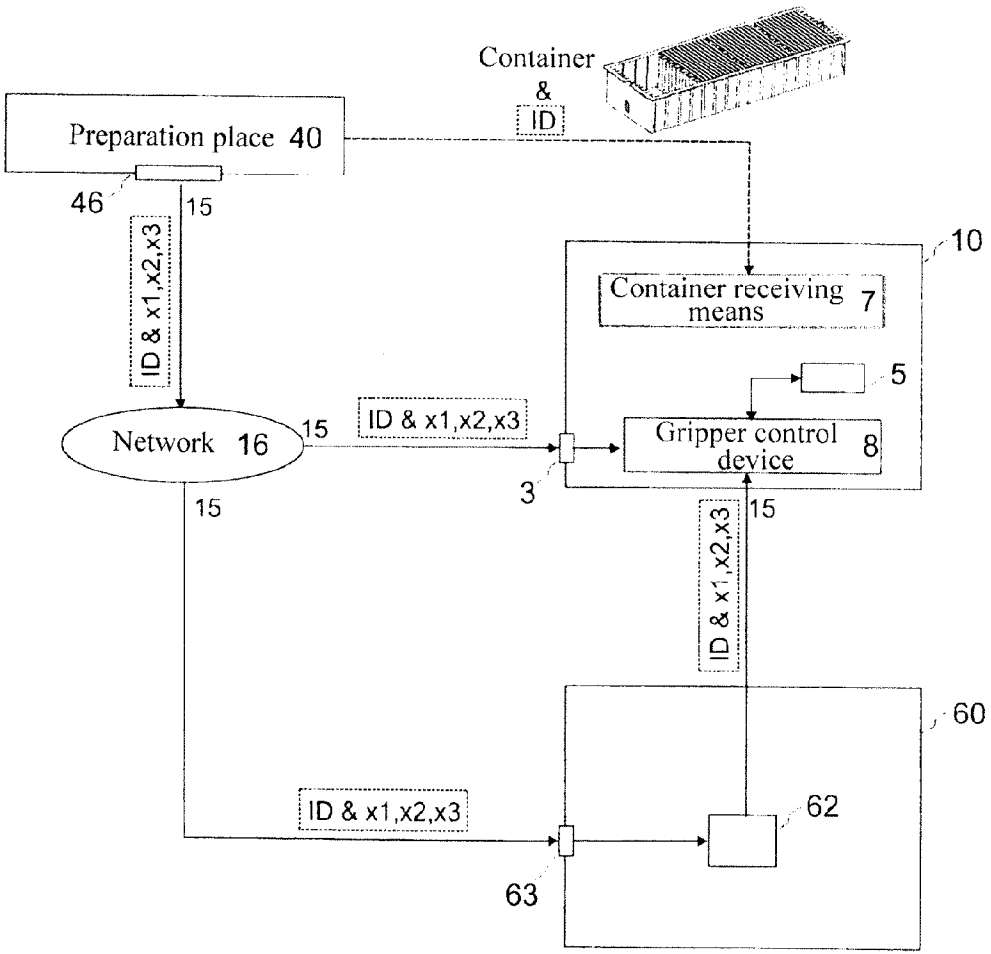

FIG. 3 shows the possible information flow of the information items about the separator element position for some exemplary embodiments, in which the separator element positions are ascertained spatially remote from the input module 10 and from the value document processing apparatus 60. The spatially remote position is e.g. a preparation place 40 which is equipped with an operator interface 46, for instance a preparation place according to FIG. 2, or an office of a depositor. At the preparation place 40 at the operator interface 46 an operator inputs the separator element position linked with a container identification ID of the respective container. The operator can input the separator element positions either for the respective container individually or associate the respective container to one of several specified container types whose separator element positions are priorly known.

The digital information items about the separator element positions x of the respective container, linked with the container identification ID, which information items were generated at the spatially remote position, are subsequently sent via data connections 15 to a network 16, from which the information items are transferred e.g. directly via a network interface 3 to the gripper control device 8. Alternatively, the information items about the separator element positions x linked with the container identification ID can also be transferred from the network 16 to the network interface 63 of a value document processing apparatus 60, from which the information items are then forwarded to the gripper control device 8 by the control unit 62. When the respective container 100 is then delivered from the spatially remote position and received in the container receiving means 7 of the input module 10 at a later time, the information items about the separator element position x belonging to this container are thus already available. The delivered container 100 is then associated with the correct information items about the separator element positions with the aid of its container identification ID. For this purpose, the container identification ID of the delivered container 100 is read in by a reading device 4 of the input module and this container identification is sought in the data memory 5 of the gripper control device. From the separator element positions which in the data memory 5 are linked with the stored container identifications ID, ID1-IDn those separator element positions x1, x2, x3 are inferred which are linked with the container identification ID of the delivered container 100. The gripper control device 8 then employs the information items inferred from the data memory 5 for controlling the gripper 8 upon the removal of the value documents from the delivered container 100. These information items can also be employed as a basis for the plausibility check of the positions of the separator elements, which were ascertained by the sensors 2.

The invention claimed is:

1. A method for removing value documents from a transportable container with the aid of a gripper which is configured for removing value documents contained in the container, comprising the steps:

transporting a container which is open on one side and which is subdivided into several storage regions for value documents by separator elements to a capture region of the gripper;

ascertaining at which positions of possible separator element positions along the container the separator elements are variably arranged, the positions of the separator elements being ascertained with the aid of a plurality of sensors arranged independently of the gripper, each of the possible separator element positions of the container being checked by a respectively different one of the sensors as to whether at the respective possible separator element position there is actually present a separator element in the container;

transferring information items about the separator element positions belonging to the container to a gripper control device which is configured for controlling the motion of the gripper; and moving the gripper for removing value documents from the container, the gripper control device controlling the motion of the gripper corresponding to the obtained information items about the separator element positions in such a way that the gripper is positioned at a lowering position above the respective separator element and from the lowering position is lowered into the container in order to remove value documents from the container.

2. The method according to claim 1, wherein ascertaining the separator element positions is carried out at a time before the gripper is moved toward the container for removing the value documents from the container.

3. The method according to claim 1, wherein the separator element positions of the container are automatically ascertained simultaneously for several separator elements of the respective container, or for all the separator elements of the respective container, before the gripper starts removing the value documents from the container, or before the gripper is moved toward the container for removing the value documents from the container.

4. The method according to claim 1, wherein the plurality of sensors are arranged along a container receiving means into which the container is inserted for removing the value documents.

5. The method according to claim 4, wherein the sensors are arranged along the container receiving means and wherein the check of the possible separator element positions is carried out before the gripper starts removing the value documents from the container, or before the gripper is moved toward the container for removing the value documents from the container.

6. The method according to claim 1, wherein the information items about the separator element positions are ascertained beyond a defined capture region of the gripper and stored in a data carrier of the container, and that the information items about the separator element positions are read out from the data carrier of the container and transferred to the gripper control device by a reading device before the gripper starts removing the value documents from the container, or before the gripper is moved toward the container for removing the value documents from the container.

7. The method according to claim 1, wherein the information items about the separator element positions are ascertained outside the capture region of the gripper and these are linked with a container identification of the respective container and that the container identification, together with the information items about the separator element positions linked therewith, is transferred via a data connection to the gripper control device before the gripper starts removing the value documents from the container, or before the gripper is moved toward the container for removing the value documents from the container.

8. The method according to claim 1, wherein:

for several containers there are respectively stored the container identification and the separator element positions in a data memory in such a way that the respective separator element positions are linked with the respective container identification; and that, before the start of the value document removal from a container to be processed, the container identification of the container to be processed is read out by a reading device; and that, from the container identifications contained in the data memory and linked with the respective separator element positions, the separator element positions linked with the read-out container identification of the container to be processed are found before the gripper starts removing the value documents from the container, or before the gripper is moved toward the container for removing the value documents.

9. The method according to claim 1, wherein the information items about the separator element positions are ascertained by an operator and the operator inputs the information items about the separator element positions at an operator interface before the gripper starts removing the value documents from the container, before the gripper is moved toward the container for removing the value documents from the container, or before the gripper has terminated the removal of value documents from the previously processed container.

10. The method according to claim 1, wherein before the removal of the value documents from the container the information items about the separator element positions are checked, are checked for plausibility, and the removal of the value documents by the gripper is stopped, if the check, the plausibility check, indicates a faulty state of the container.

11. An apparatus for removing value documents from a transportable container which is open on one side and is subdivided into several storage regions for value documents by means of separator elements variably positioned at possible separator element positions, wherein the apparatus comprises:

a device for transporting the container to a capture region of the gripper;

a gripper for removing value documents contained in the container;

a gripper control device for controlling the motion of the gripper;

a device which is configured to take up information items about the positions of the separator elements with the aid of a plurality of sensors arranged independently of the gripper, each of the possible separator element positions of the container being checked by a respectively different one of the sensors as to whether at the respective possible separator element position there is actually present a separator element in the container, and which is connected with the gripper control device in order to transfer the taken information items about the positions of the separator elements to the gripper control device;

wherein the gripper control device is configured to control the motion of the gripper, for removing value documents from the container, in accordance with the transferred information items about the separator element positions, in such a way that the gripper is positioned at a lowering position above the respective separator element and is lowered from the lowering position into the container in order to remove value documents from the container.

12. The apparatus according to claim 11, wherein the apparatus has a container receiving means at which the container is received in such a way that the relative position thereof to the gripper is predetermined and reproducible.

13. The apparatus according to claim 12, wherein the apparatus has a plurality of sensors, which are arranged along the container receiving means, wherein the sensors are arranged along the container receiving means in such a way that the sensors can simultaneously ascertain several separator element positions of a container received in the container receiving means.

14. The apparatus according to claim 11, wherein the device is a reading device which is configured for reading out the information items about the separator element positions from a data carrier of the container received in a container receiving means.

15. The apparatus according to claim 11, wherein the device is a communication interface which is configured for receiving the information items about the separator element positions of the container from at least one of a component or a device that is separate from the apparatus.

16. The apparatus according to claim 11, wherein the device is an operator interface, into which the information items about the separator element positions can be input by an operator, and which can generate corresponding digital information items from the input information items.

17. The apparatus according to claim 11, wherein the apparatus has at least one sensor, by which the separator element positions of the container are automatically ascertainable before the gripper is moved toward the container.

* * * * *